United States Patent [19]

Collens

[11] Patent Number: 4,553,670

[45] Date of Patent: Nov. 19, 1985

[54] MEDICAL REMINDER DEVICE

[76] Inventor: Richard Collens, 613 Pinebrook Blvd., New Rochelle, N.Y. 10804

[21] Appl. No.: 558,964

[22] Filed: Dec. 7, 1983

Related U.S. Application Data

[63] Continuation of Ser. No. 316,917, Oct. 30, 1981, abandoned, which is a continuation of Ser. No. 123,011, Feb. 20, 1980, abandoned.

[51] Int. Cl.[4] ..... B65D 83/04

[52] U.S. Cl. ..... 206/534; 206/44.11; 116/308

[58] Field of Search ..... 206/534, 44.11, 538, 206/539, 828, 44.11 R, 528, 459, 540, 561; 434/379, 386, 429; 40/312, 313; 116/308

[56] References Cited

U.S. PATENT DOCUMENTS

| | | | |
|---|---|---|---|
| 1,844,189 | 2/1932 | Stuart | 206/534 |
| 3,367,484 | 2/1968 | Nelson | 206/44.11 |
| 4,039,080 | 8/1977 | Cappucilli | 206/534 |

*Primary Examiner*—Gene Mancene
*Assistant Examiner*—James R. Hakomaki
*Attorney, Agent, or Firm*—Diller Ramik & Wight

[57] ABSTRACT

A reminder device comprising a support on which are located at least two different medicinal substances each of said drugs being in single dose form and an instruction bearing portion on said support adjacent each dose to receive instructions for the use thereof.

1 Claim, 2 Drawing Figures

MEDICAL REMINDER DEVICE

This application is a continuation of application Ser. No. 316,917 filed Oct. 30, 1981, which is a continuation of Ser. No. 123,011 filed Feb. 20, 1980 now abandoned.

This invention relates to a medical reminder device which can be used by a doctor or pharmacist as a reminder to a patient as to how at least two different medicinal substances each of which is in single dose form are to be taken by the patient under different conditions.

At the present time when a doctor or pharmacist issues at least two different forms of medicine it is usual for them to be provided in separate containers, such as boxes or bottles which are marked with instructions for the patient. Thus, the medicines might include one form of drug which is in encapsulated form, one capsule being taken at bedtime and another form of drug made into pills which are, for example, to be taken once every six hours. In these circumstances it is easy for the patient to forget how to take the drugs and the present invention is intended to provide a reminder device bearing instructions for taking each of the drugs of a particular course of treatment.

According to the present invention therefore a medical reminder device comprises a support on which are located at least two different medicinal substances each of said substances being in single dose form and an instruction bearing portion on said support adjacent each dose to receive instructions for the use thereof.

Thus, the doctor or pharmacist can place the various substances on the support and write the necessary instructions alongside each medicinal substances as required.

The user now has examples of all the drugs and all the instructions in a simple pack.

Preferably each dose is carried in separate location means provided on said support and in a convenient construction each location means can be in the form of a transparent container.

The support can be in sheet form with said doses being located towards one side edge thereof.

With this kind of construction the containers may conveniently be provided by a plastics material blister wrap secured to a backing and which can be filled and closed from the rear surface of said backing.

The rear surface of said support can be provided with attachment means for securing it to a vertical surface so that the pack can be attached, for example, to a medicine cupboard.

Thus, the rear surface can be provided with a self-adhesive attachment means.

Figure 1:
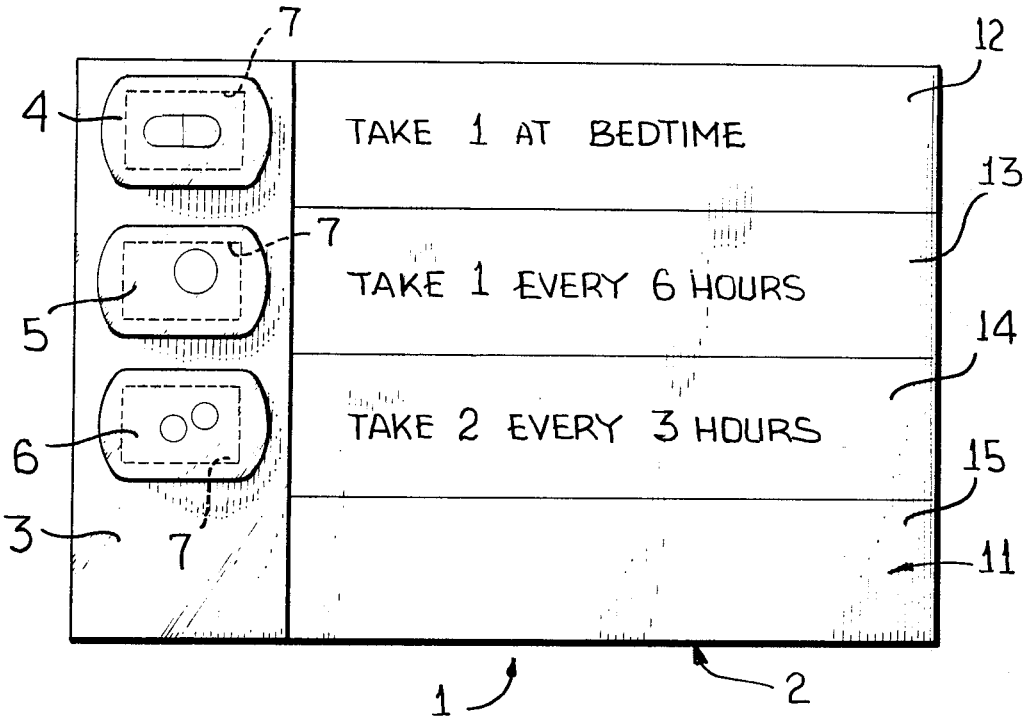
Figure 2:
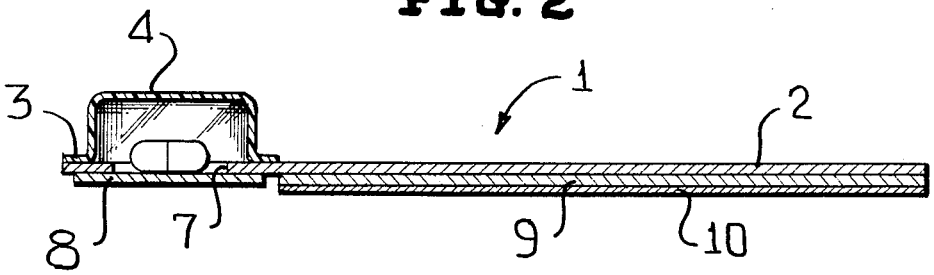

The invention can be performed in many ways but one embodiment will now be described by way of example and with reference to the accompanying drawings in which:

FIG. 1 is a plan view of a remainder device according to the invention; and, FIG. 2 is a cross-sectional view taken on the lines II—II of FIG. 1.

As shown in the drawings the reminder device according to the invention comprises a support 1 which consists of a cardboard backing sheet 2 to one end of which is attached a plastics material blister wrap 3. The technique of making and attaching such wraps is well known and will not therefore be further described. The blister wrap provides three transparent bubbles indicated by reference numbers 4,5, and 6 in FIG. 1. The cardboard sheet 2 is cut away to provide an opening 7 behind each of the bubbles 4, 5 and 6 and an adhesive sealing strip 8 is provided on the rear face of the sheet 2 to seal the openings.

Also provided on the rear face is a self-adhesive sheet 9 which has a cover strip 10.

The front face 11 of the cardboard sheet 2 is marked to provide three instruction bearing portions 12, 13 and 14 by appropriate printing or other marking, although obviously, the size of the sheet 2 may be such as to accomodate additional instruction bearing portions, such as the portion 15 presently devoid of instructions. As will be seen from FIG. 1 each of the instruction bearing portions is adjacent to and aligned with one of the bubbles 4,5 and 6.

Reminder devices of this kind can be supplied to doctors, druggists and pharmacists so that when they wish to prescribe a particular course of treatment the particular medicines in single dose form can be placed in the blisters 4,5 and 6 and appropriate instructions written in the spaces 12, 13 or 14 alongside each dose. In the made up pack shown in the drawings bubble 4 carries a capsule containing a drug and the instructions "take one at bedtime" are written alongside. Bubble 5 is provided with a pill with the instructions "take one every six hours" and bubble 6 is also provided with a pill of a different type with the insructions "take two every three hours".

To keep the pack in a readily useable location the cover strip 10 can be removed from the adhesive backing 9 thus enabling the pack to be attached, for example, to a medicine cabinet.

A patient need only refer to the reminder device 1 at anytime of the day or night and the same will readily remind him which medication need be taken at a particular time or interval. At such time he need but select the appropriate medication from its respective conventional container. In this manner the reminder device 1 functions soley as a reminder to the patient, and the medication in the blisters 4,5,6 is at no time removed therefrom for consumption.

I claim:

1. A method of dosing dispensible ingestible medicinal substances from dispensing containers by correlating the same with respect to identical ingestible though nondispensible medicinal substances comprising the steps of providing a generally planar sheet having opposite surfaces and at least first and second normally open chambers each generally immediately adjacent respective first and second surface portions of the sheet upon which instructions may be written; selecting from first and second sources respective first and second dispensible ingestible medicinal substances and placing a plurality of the first dispensible ingestible medicinal substances in a first dispensing container and a second plurality of the second dispensible ingestible medicinal substances in a second dispensing container with the first and second sources and dispensing containers being separate and isolated from each other and from the first and second open chambers; placing at least one of the first and second dispensible ingestible medicinal substances into the respective first and second normally open chambers; closing the chambers to thereby render the latter ingestible medicinal substances nondispensible while permitting the same to be viewed therein; placing dosing instructions on said first and second surface portions to specifically define the manner, number and/or time at which the first and second nondispensible ingestible medicinal substances in the respective first and second chambers are to be ingested; and following said dosing instructions withdrawing said first and second ingestible medicinal substances from the respective first and second dispensing containers and dosing a patient therewith in the absence of dosing from the first and second chambers whereby, though ingestible, the ingestible medicinal substances of the first and second chambers are neither dispensed nor ingested and function solely as a reminder to select the same dispensible and ingestible medicinal substances from the first and second dispensing containers.

* * * * *